United States Patent [19]

O'Boyle et al.

[11] Patent Number: 4,519,137

[45] Date of Patent: May 28, 1985

[54] BRASSIERE

[75] Inventors: Dolores O'Boyle, Woodridge; Phyllis Shonk, Glen Rock, both of N.J.

[73] Assignee: International Playtex, Inc., Stamford, Conn.

[21] Appl. No.: 584,900

[22] Filed: Feb. 29, 1984

Related U.S. Application Data

[60] Continuation of Ser. No. 422,611, Sep. 24, 1982, abandoned, which is a division of Ser. No. 219,111, Dec. 22, 1980, Pat. No. 4,393,875.

[51] Int. Cl.[3] ..... A41H 3/06

[52] U.S. Cl. ..... 33/17 R

[58] Field of Search ..... 128/425, 580, 492, 442, 128/443; 33/17 R, 17 A, 12–16

[56] References Cited

U.S. PATENT DOCUMENTS

| | | | |
|---|---|---|---|
| 2,091,262 | 8/1937 | Aster . | |
| 2,420,774 | 5/1947 | Goldsholl | 128/492 |
| 2,465,171 | 3/1949 | Roth | 128/492 |
| 3,177,867 | 4/1965 | Hart | 33/12 X |
| 4,137,634 | 2/1979 | Klamar | 33/14 |

FOREIGN PATENT DOCUMENTS

| | | | |
|---|---|---|---|
| 877004 | 9/1961 | United Kingdom | 128/490 |

*Primary Examiner*—Harry N. Haroian

*Attorney, Agent, or Firm*—Stewart J. Fried

[57] ABSTRACT

A method of grading a series of brassieres of like styling for women having the same body dimension except for breast sizes is provided. Each brassiere includes a pair of breast receiving cups for supporting the breasts of a woman, and body encircling components associated with the pair of breast receiving cups and sized to fit around the body of each woman. The method includes the steps of measuring the diaphragm dimension and body chest dimension of a woman having average sized breasts for the series of brassieres, determining by formula the breast size of the woman having average sized breasts based upon the measurements of the diaphragm and body chest dimensions, and reducing the size of the breast receiving cups while maintaining substantially the same the length of the body encircling components to accommodate a desired breast size of a second woman having less than the determined average breast size. The reducing step also includes reducing the depth dimension of the breast receiving cups in accordance with the reduction from the determined average breast size to the breast size to the desired breast size for the second woman, and reducing the overall perimeter of the cups in accordance with desired breast size for the second woman by (1) maintaining substantially the same lower arcuate extent of the cups so that the length of the body encircling component remains substantially the same and, (2) reducing the remainder of the parameter of the cups to the desired breast size.

1 Claim, 7 Drawing Figures

BRASSIERE

CROSS-REFERENCES TO RELATED APPLICATIONS

This application is a continuation of application Ser. No. 422,611, filed Sept. 24, 1982, now abandoned, which in turn is a division of application Ser. No. 219,111, filed Dec. 22, 1980, now U.S. Pat. No. 4,393,875 which issued July 19, 1983.

BACKGROUND OF THE INVENTION

The present invention relates to brassieres particularly suitable for women of smaller than average bust volume and to the method of sizing the same.

1. Field of the Invention

Research has shown that there is a high level of dissatisfaction among small busted women concerning the fit of their brassieres and that the established procedures for sizing these brassieres in mass production does not accurately reflect the wearers needs.

Brassieres for the most part are produced in standard sizes based upon the around the body dimension of the wearer, and a cup volume designation. In the United States the body measurement is stated in inches and is divided into two inch increments, e.g. 30, 32, 34, 36, 38. Cup volume is referred to by the letters of the alphabet beginning at AA and progressing to A, B, C, D, and DD with AA being the smallest volume size.

2. Background of the Prior Art

As is well known in the brassiere manufacturing industry, when a brassiere style is being developed it is initially fitted to a particular size. The size which is customarily used is size 34B, because it is considered to be generally representative of the most commonly worn size. A master pattern for each of the major brassiere components is developed from this size 34B prototype. This master pattern is then used in making pattern for other sizes. This latter activity is called grading and its broadest sense is typical of the grading systems used in the sizing of clothing in general, such as referred to in U.S. Pat. No. 2,091,262, to Aster.

It has been the accepted industry practice in the grading from the size 34B to smaller volume capacity cup sizes, e.g. size 34A, to reduce on a proportional basis, both the depth of the breast receiving cup and the entire perimeter of the breast receiving cup. By proportionally reducing the entire circumferential perimeter of the cup, the remaining body encircling portions are required to be elongated so that the around the body fit (e.g. 34 inches) could be achieved. The reduction in the circumference of the cup perimeter on a proportional basis also results in the lower edge of the cup being positioned upon the chest wall in the size 34A brassiere differently than in a size 34B brassiere of like styling.

While it has been well known that dissatisfaction with fit was being experienced by A and AA cup wearers (as well as with wearer's on the lower end of the B cup range), only limited success has been achieved in correcting the problem. One approach has been to add padding to the cups to have the cups approximate the volume of a larger volume cup. Other workers in the art have provided non-supporting stretch cups, but these cups merely cover the breasts and do not support or aid in shaping them. These approaches employ the traditional grading method.

As hereinafter set forth, the present invention has recognized the deficiences in the prior practices and provides brassieres and a method of sizing the same which economically permits mass production of better fitting brassieres for smaller than average busted women.

SUMMARY OF THE INVENTION

In an attempt to overcome the problems of the past, a study was undertaken of the anatomy of the smaller busted women in the hope of ascertaining why present brassiere products are not meeting these women's needs. The research was directed to identifying the figure type of smaller busted women relative to bust proportion, volume and the manner in which these dimensions interrelate to the configuration of a brassiere.

The study included brassieres of the type generally worn by smaller busted woman, that is, the unpadded (also referred to as "soft cup") type; the slightly padded and fully padded type and the underwire type.

Screening was conducted and a sampling of women in the small busted category (chest size ranges of 30–38 inches with cup volume ranges of AA–B) was selected. Each woman participated in a session in which she was measured wearing her own brassiere (whether it was a soft cup, slightly padded or fully padded brassiere).

In addition to the accepted industry measurements, additional measurements were taken.

The generally accepted industry measurements were used to determine the proper brassiere size. The standard determines size as a function of the diaphragm dimension, the around the body chest dimension and the bust dimension.

The accepted industry measurements include two basic around the body measurements. The first is the diaphragm measurement which determines the enumerated brassiere size (e.g. 34) and which is taken around the body below the breasts. The second is the body chest dimension which is taken around the body along the high points (areola) of the breasts. While there are variations between manufacturers in reaching the determination as to cup volume, the formula which in its general sense is universally followed, is to compute the bust size based upon the difference in measurement between the chest measurement and the bust measurement. For example, at least one manufacturer's formula is based upon the the following differences; if the bust is up to ½ inch larger then the chest, the cup size is AA; if the bust is over ½ inch to 1½ inches larger than the chest, the cup size is A; and if the bust is over 1½ inches and cup to 2½ inches larger than the chest, the cup size is B. (In countries where metric measurements are employed, the same general principles are employed).

In addition, to the foregoing measurements, other detailed anatomical measurements were taken, measuring various locations along the height of the body; from the shoulders to the breasts; from the waist to the breasts, etc. The data obtained in these studies included not only the specific dimensions but the torso characteristics of less than average busted women.

The result of the study confirmed that the industry grading system did not provide an optimium fit for the typical less than average busted woman.

Aside from the differences noted in what had been heretofore assumed to be the median chest dimension in smaller busted woman, the major difference noted was that the standard grading technique of proportionally reducing the depth and the perimeter of the cups in grading from a size B cup to a size A cup was inappropriate. Proportional reduction resulted in a brassiere in which the cups and sides were not optionally positioned on the body. As a result of the cup perimeter being reduced in all dimensions, a longer body encircling member is required to compensate for the around the body length not taken up by the breast receiving cups. This mispositions the cups and side panels. For example, the side panel instead of being positioned along the turn of the body, (that is where the rib cage curves toward the back of the anatomy) extends along the front of the body.

According to the present invention, when compared to brassieres for average busted woman, the perimeter of the cups for smaller busted woman are not proportionately reduced. While some portions of the perimeter are reduced, the length of the respective arcs of each cup along its upper and lower sections are not reduced. The standard around the body measurement is maintained and the mispositioning of the side panels is avoided.

Sizes are selected from predetermined paired groupings of chest measurement ranges to diaphragm measurement ranges preferably for less than average busted woman, i.e., women whose bust measurement does not exceed their chest measurement by more than 2 inches. The bust cup size designation is preferably selected from subdivisions within this bust measurement ranges. By employing the teachings of the present invention the cups and sides of the brassiere provide a superior fit for a significant segment of that population. The bust retaining cups have a depth adapted to closely fit the bust of the wearer within each selected designation and the cups are appropriately positioned with respect to other elements of the brassiere. Each cup perimeter portion is adapted to overlie the chest wall of the wearer in juxtaposition to the bust along at least the lower portion of the chest wall where the bust of the wearer extends outward of the chest wall. This is the positioning which was established in the prototype 34B brassiere. The extent of the body encircling member when measured from a point along the outer perimeter edge of one of said cups to a like point along said outer perimeter edge of the other of said cups is substantially the same for all brassieres of the same style and chest measurement (e.g. 34) irrespective of the bust size measurement.

Preferably the pairings are selected by matching a range of chest measurement dimension with a range to diaphragm measurement.

| Pairing | Chest Measurement (in inches) | Diaphragm Measurement (in inches) |
|---|---|---|
| 1 | 28–30 | 24–26 |
| 2 | 30–32 | 26–28 |
| 3 | 32–34 | 28–30 |
| 4 | 34–36 | 30–32 |
| 5 | 36–38 | 32–34 |

The bust measurement ranges are in predetermined grouping beginning from a measurement which is larger than the wearer's chest dimension and progresses up to 2 inches longer than the wearer's chest measurement.

The invention provides a method of grading brassieres which begins with a fit brassiere with breast receiving components adapted to fit a woman of a given breast volume capacity and body encircling components adapted to fit around the body of the women, to a brassiere of a different size to be worn by a woman having a smaller breast volume capacity, but like around the body dimension. The method comprises the steps of reducing the depth of the breast receiving components without decreasing the arc which extends along the lower edge of the breast receiving component and maintaining substantially the same length of the body encircling components. The result is that in a series of brassieres of like styling, the breast receiving components will be of varying capacity, but the diaphragm encircling members will be substantially equal in length.

It is to be understood that in discussing the components of a brassiere, generic components have been described. Designers have in the past, and will no doubt continue in the future, change the aesthetics of brassieres by providing cup constructions of a simple or complex shape and body encircling means of varying constructions. As employed herein, reference to a breast receiving component or cup is intended to include that portion of the brassiere which provides the three-dimensional breast receiving component. It is possible that the fabric which makes up the cup will extend beyond the breast tissue, however, it is the breast receiving portion that is referred to herein.

Reference to the perimeter of the breast receiving component or cup refers to that portion of the cup which lies against the chest wall along the line where the breast tissue extends outward of the chest wall (along the bottom of the breast, this is generally referred to in the industry as the "break" of the breast). Reference to body encircling components refer to side panels or back panels whether of one piece or not. However, it is also to be understood that it is the distance from outer cup edge to outer cup edge that is critical to fit and the present invention is applicable to products where there is no expanse of fabric from outer cup edge to outer cup edge such as a halter.

While the advantages of the present invention have been and will be illustrated in the form of a bandeau brassiere, the advantages may be employed in other garments where breast receiving members are employed, such as corselettes and bathing suits or the like and reference to the term "brassiere" is intended to include such garments.

BRIEF DESCRIPTION OF THE DRAWINGS

The above description as well as further features of the invention will be more fully understood by reference to the following detailed descriptions of the embodiments illustrated in the accompanying drawings, in which.

Figure 1:
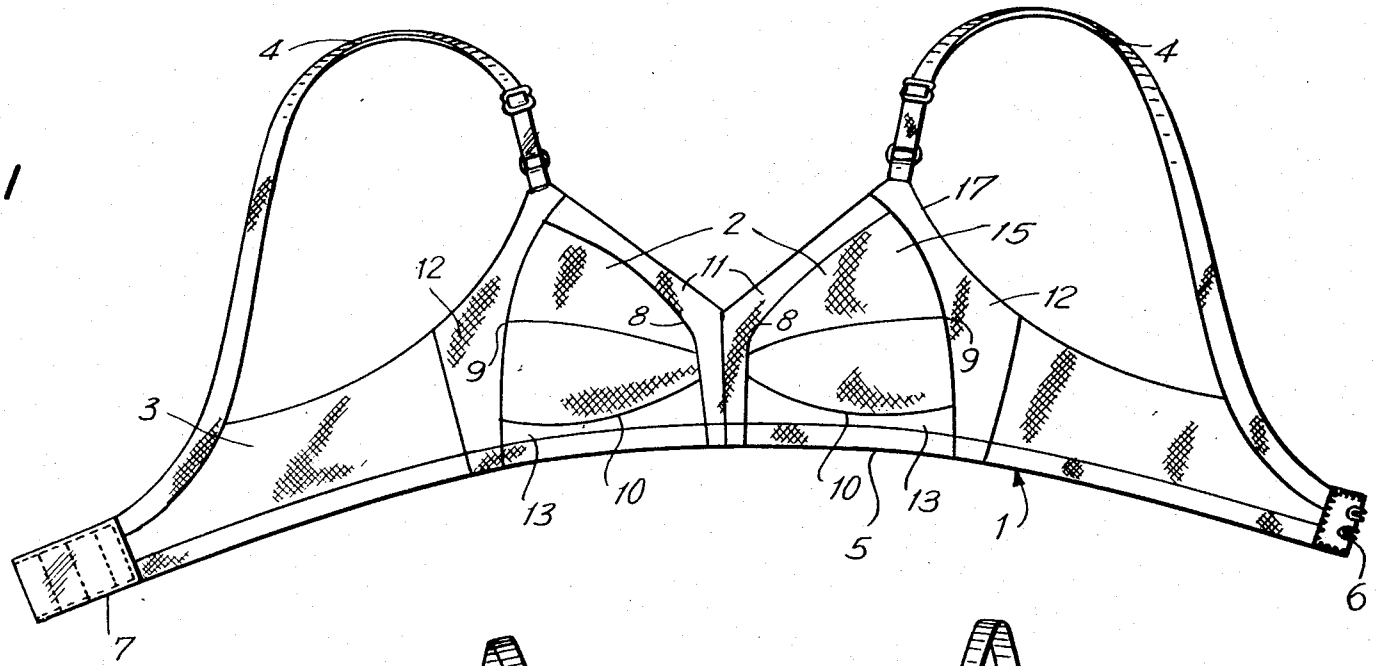
FIG. 1 is a front perspective of a brassiere according to the present invention.

As is understood by one skilled in the art, in designing and fitting a brassiere care is taken to shape and locate the various parts of the garment with respect to the prospective wearer's anatomy in order for the brassiere to properly function. A properly designed brassiere does more than merely cover the breast tissue. The cups are designed to shape and support the bust of the wearer, both in an at rest position and during normal day to day activities. The cup being a flaccid material, much of its shaping and supporting capabilities are provided by other sections of the brassiere, as they are stressed by the body. The body tensions the parts which exert a tension to the perimeter of the cups. A major component is the around the body tension which is exerted primarily by the side panels. A designer strives to create a balance of these stresses and achieve an acceptable fit for a reasonably large segment of the population.

The method most commonly employed today by designers is to design and fit the prototype brassiere on a live model whose body dimensions place her in the midrange of sizes, a 34B brassiere. While the shape and dimensions of the breast and size in women who wear the same size differ, the malleable nature of the breast tissue permits a well designed 34B brassiere to fit a fairly large segment of the wearing population. So long as those portions of the brassiere which tension the cups lie along the appropriate sections of the anatomy and maintain their relative position in wear, the brassiere will retain its balance. If there is mispositioning of a component, an imbalance (and/or discomfort) is likely.

Once a designer is satisfied with the fit of the prototype size 34 brassiere, the next step is grading. Patterns are made for the various size brassiere components in the size 34B prototype and grading to other sizes is undertaken. Following the accepted industry practice, a prior worker would, in grading down to lesser volume cup sizes, proportionally reduce the entire cup perimeter and elongate the side panels. The present invention changes this method of grading by substantially maintaining the length of the side panels and the arc along the lower perimeter. The result is a brassiere for the smaller busted woman which is positioned on the body in substantially the same relative position of the prototype fit of the larger busted model.

Referring now to the figures, like reference numerals denote like parts.

Figure 2:
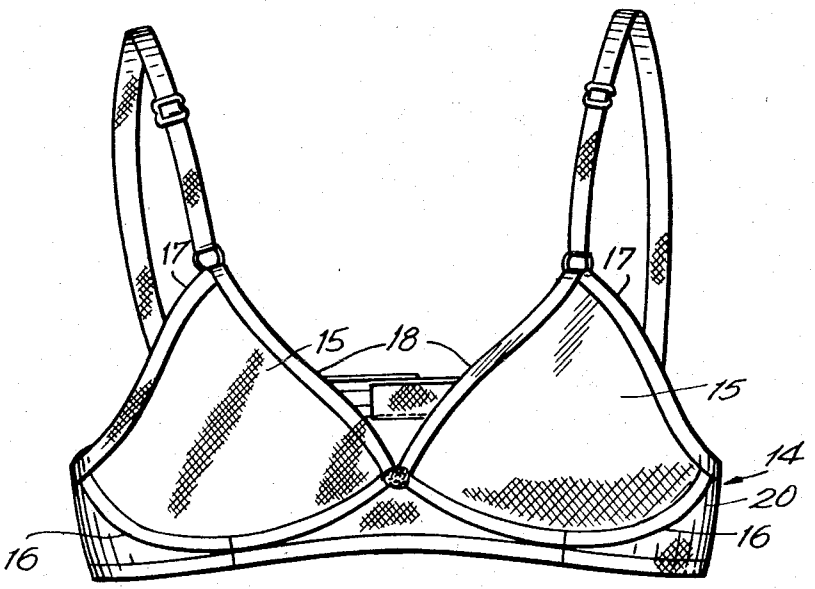
FIG. 2 is a front perspective of another brassiere according to present invention.

FIGS. 1 and 2 represent two differently constructed brassieres. They are generally illustrative of the diverse nature of brassiere design and the general applicability of the present invention.

The brassiere 1 shown in FIG. 1 is of the type generally referred to in the art as a framed brassiere with set-in cups. It includes a pair of breast receiving cups 2, a pair of side panels 3, a pair of shoulder straps 4, a bottom band 5 and closure means in the form of a hook 6 and eye 7 arrangement on the distal ends of the side panels 3.

The cups are illustrated as being of the cut and sewn variety. It is to be understood that seamless molded cups are also contemplated within the scope of the invention. Each cup 2 includes an inner edge 8, and outer edge 9 and a bottom edge 10. These edges collectively define the perimeter of the cups 2 which lie upon the chest wall where the breast tissue of a wearer extends outward of the chest wall. Beyond the perimeter of each cup 2 is an inner cup framing member 11 and outer cup framing member 12. These framing members 11 and 12 aid in the fit and supportive characteristics of the brassiere in a manner known to those skilled in the art. The framing members 11 and 12 in the embodiment of FIG. 1 are adapted to lie upon the chest wall. In other brassiere constructions, cup framing members may form a part of the breast tissue encompassing portion of the cups. In the latter case, the outer and inner cup edges of the cups as those terms are employed herein would refer to the portions of the framing members which define the arcuate perimeter where the breast tissue extends outward of the chest wall of a wearer.

Beneath the bottom edge 10 of the cups 2 illustrated in FIG. 1 is a crescent shaped panel 13 which lies flat along the chest wall. The upper edge of the crescent shaped panel 13 is arcuate and extends along the bottom edge or "break" of the cup 2. The crescent shaped panel 13 and the bottom band 5 help prevent the brassiere 1 from rising upward onto the breast tissue.

Figure 3:
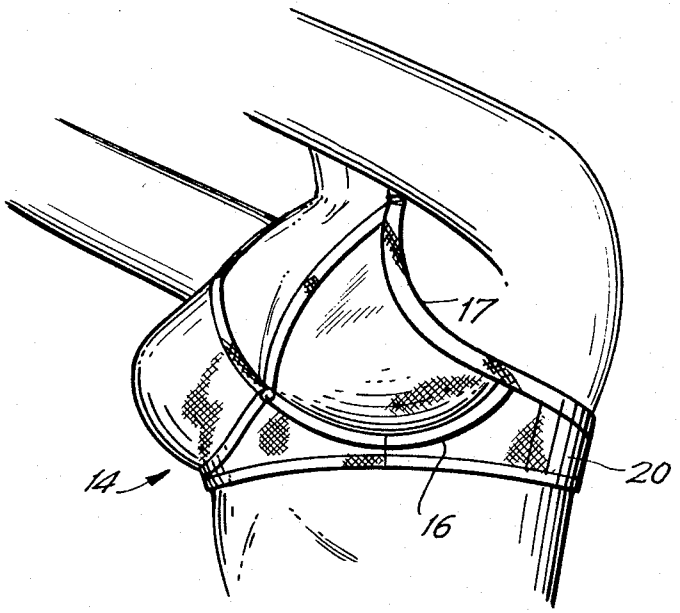
FIG. 3 is a side perspective of the brassiere of FIG. 2 shown on a wearer.

FIGS. 2 and 3 illustrate a brassiere 14 which is less structured than that shown in FIG. 1. There are less seams, no framing panels and less of the anatomy is intended to be covered. The cups 15 are seamless. The bottom edge of each cup 16 extends as an arcuate curvilinear extent. In combination with edge portion 17, the bottom edge 16 forms the outer edge of the cups. The inner edges 18 of the cups and the absence of framing members provides a decollete effect. A single extent of material extends beneath both cups as a bust band 20. While the design of the brassiere 14 is different than that of the brassiere 1 of FIG. 1, the principles of the grading system of the present invention may be equally applied to both. In grading either the brassiere 1 or the brassiere 14 of FIG. 2, the arcuate extent along the bottom edge 10, 16 is maintained.

In the past the entire perimeter of the cup was proportionally reduced. As a result, the length from the outer cup edge of one cup, around the back, to the other outer cup edge of the cup increased to maintain the same overall girthwise extent around the body.

Figure 4B:
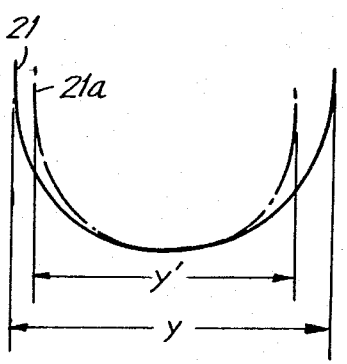
FIG. 4*a* and 4*b* are schematic representations, 4*a* being a side view and 4*b* being a front view of two brassiere cups with the cup in solid lines representing a B cup and the cup in broken lines representing an A cup according to the present invention.
Figure 4A:
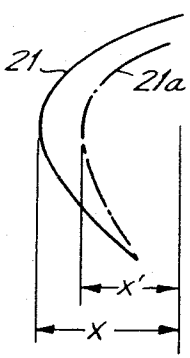
Figure 5:
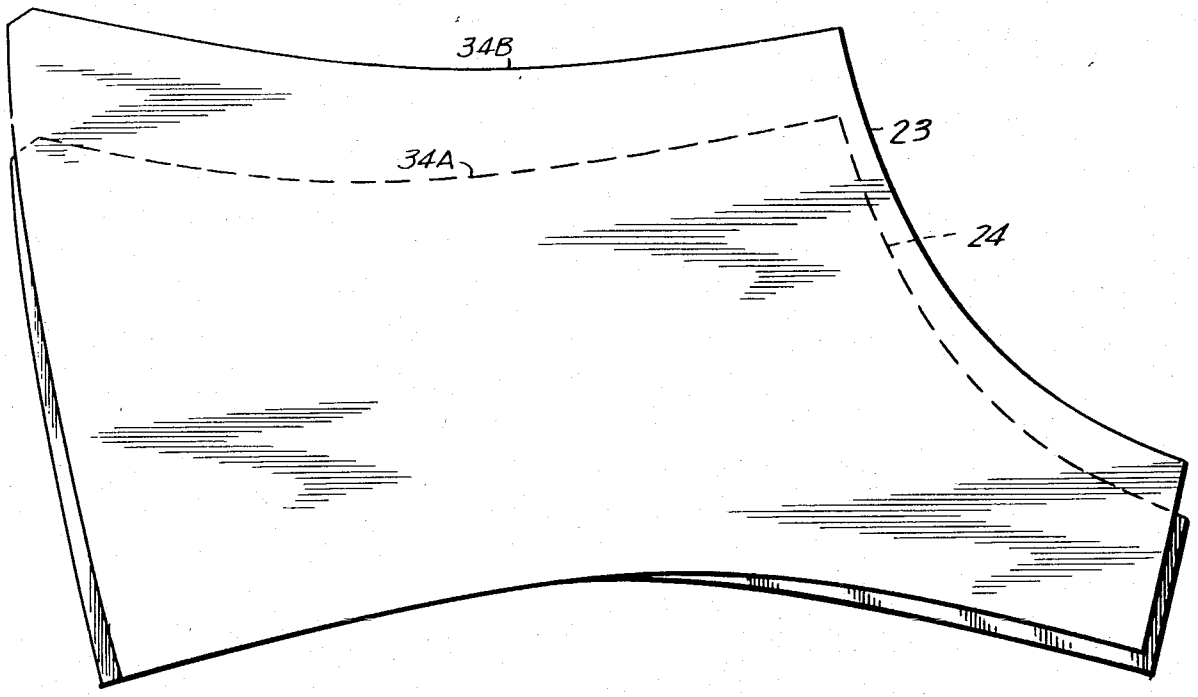
FIG. 5 is an elevational view showing in superimposition, two brassiere side panels with the panel shown in solid lines adapted to be incorporated into a brassiere worn by a woman who wears a size 34B brassiere in accordance with the present invention, and the panel shown in broken lines adapted to be incorporated into a brassiere worn by a woman who wears a size 34A brassiere in accordance with the present invention.

As illustrated in FIGS. 4*a*, 4*b* and 5, in accordance with the present invention, it is the depth of the cups (from x to $x^1$) which is primarily modified. In FIGS. 4*a* and 4*b* the solid lines 21 represent the B cup and the broken line 21*a* represents the A cup. As best seen in FIGS. 4*a* and 4*b*, although the height, width ($y-y^1$) and depth ($x-x^1$) of the cups are reduced, the arcuate extent (along the bottom edge 10, 16 as referred to in FIGS. 1-3) remains relatively constant in B cups and those cups smaller than the B cup.

Each A cup of the present invention is located at substantially the same position on the wearer's body as it was in the fitted B cup. Since the arcuate extent of the cups is substantially the same, the length of the body encircling sections in A cups and B cup brassieres of like style and chest measurement is also substantially the same.

As is illustrated in FIG. 5, the side panel 23 for the B cup is larger than the side panel 24 for the A cup. This is due to the difference in the height of the B cup and the A cup. However, the length of the side panels 23, 24 is substantially the same.

Figure 6:
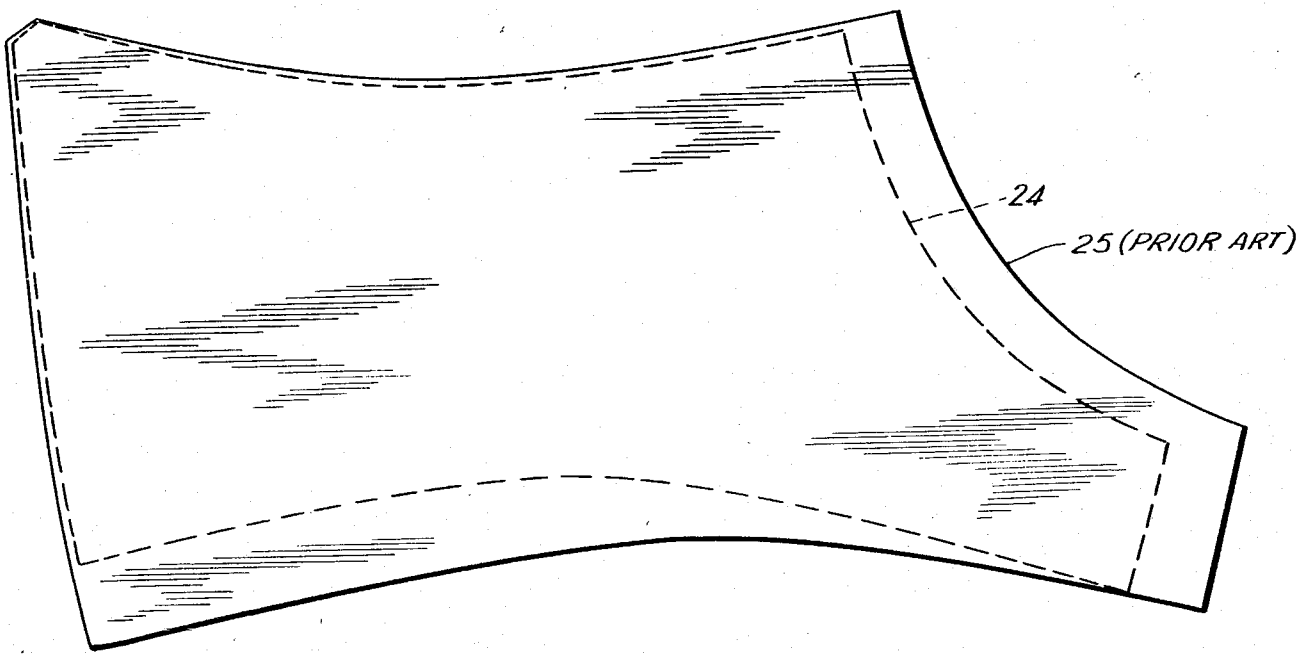
FIG. 6 is an elevational view showing in superimposition two brassiere side panels with the panel shown in broken lines being the same panel as shown in broken lines in FIG. 5 and the panel shown in solid lines being a panel for a like style and size brassiere in accordance with the prior art.

This is to be contrasted with that which is shown in FIG. 6. FIG. 6 shows the difference in the location and the size of the side panel 24 of an A cup brassiere in accordance with the present invention and side panel 25 of the prior art. As can be seen therein, the side panel 25 of the prior art is longer and positioned differently on the body than a side panel in accordance with the present invention.

When the teachings of the present invention have been applied to brassiere design, wearers of less than average bust cup size have experienced a marked improvement in fit and comfort.

Having shown and described preferred embodiments of the invention, it will be appreciated that various modifications may be made without departing from the scope of the invention as defined in the claims.

What is claimed is:

1. A method of grading a series of brassieres of like styling for women having the same body dimension except for breast sizes, based upon measurements of one woman having average sized breasts for said series of brassieres in which each brassiere includes a pair of breast receiving cups for supporting the breasts of a woman, and body encircling components associated with said pair of breast receiving cup and sized to fit around the body of each woman, said method comprising the steps of:

measuring the diaphragm dimension and body chest dimension of a woman having average sized breasts for said series of brassieres;

determining by formula the breast size of said woman having average sized breasts based upon the measurements of the diaphragm dimension and body chest dimension; and reducing the size of the breast receiving cups while maintaining substantially the same the length of the body encircling components to accommodate a desired breast size for a second woman having less than the determined average breast size by:

(a) reducing the depth dimension of the breast receiving cups in accordance with the reduction from said determined average breast size to said desired breast size for said second woman; and (b) reducing the overall perimeter of the breast receiving cups in accordance with said desired breast size for said second woman by (1) maintaining substantially the same the lower arcuate extent of the breast receiving cups so that the length of the body encircling components remains substantially the same; and (2) reducing the remainder of the perimeter of the breast receiving cups to said desired breast size for said second woman.

* * * * *

UNITED STATES PATENT AND TRADEMARK OFFICE

CERTIFICATE OF CORRECTION

PATENT NO. : 4,519,137

DATED : May 28, 1985

INVENTOR(S) : Dolores O'Boyle and Phyllis Shonk

It is certified that error appears in the above-identified patent and that said Letters Patent are hereby corrected as shown below:

Column 2, between lines 34-39 should read: The first is the diaphragm measurement which is taken around the body below the breasts. An alternative first measurement is the chest measurement, which is taken around the body under the arms and above the bust. Either the diaphragm measurement plus a constant or the chest measurement determines the enumerated bra size (e.g. 34). The second measurement is the body chest or bust dimension, which is taken around the body along the high points (areola) of the breasts. -- instead of "The first is the diaphragm measurement which determines the enumerated brassiere size (e.g. 34) and which is taken around the body below the breasts. The second is the body chest dimension which is taken around the body along the high points (areola) of the breasts.";

Column 2, line 41, should read -- a formula -- instead of "the formula";

Column 2, line 50 should read -- up to 2 1/2 - - instead of "cup to 2 1/2."

Signed and Sealed this

Twenty-ninth Day of September, 1987

*Attest:*

DONALD J. QUIGG

*Attesting Officer* *Commissioner of Patents and Trademarks*